US007096787B2

(12) United States Patent
Hino et al.

(10) Patent No.: US 7,096,787 B2
(45) Date of Patent: Aug. 29, 2006

(54) PRINTING PRESS AND METHOD OF CONTROLLING INK TRANSFER ROLLER

(75) Inventors: Masahiro Hino, Fuchu (JP); Kentaro Hayashi, Fuchu (JP)

(73) Assignee: Ryobi Ltd., Hiroshima-ken (JP)

( * ) Notice: Subject to any disclaimer, the term of this patent is extended or adjusted under 35 U.S.C. 154(b) by 0 days.

(21) Appl. No.: 11/173,239

(22) Filed: Jul. 1, 2005

(65) Prior Publication Data

US 2006/0000375 A1 Jan. 5, 2006

(30) Foreign Application Priority Data

Jul. 5, 2004 (JP) ..... 2004-197585

(51) Int. Cl.
*B41F 31/00* (2006.01)
*B41F 31/02* (2006.01)
*B41F 31/30* (2006.01)

(52) U.S. Cl. ..... 101/351.3; 101/351.1; 101/350.3; 101/485

(58) Field of Classification Search ..... 101/365, 101/350.3, 351.1, 351.3, 352.01, 352.04, 101/350.1, 349.1
See application file for complete search history.

(56) References Cited

U.S. PATENT DOCUMENTS 3,688,696 A * 9/1972 Treff ..... 101/350.4
5,152,224 A * 10/1992 Guaraldi ..... 101/350.3
5,685,225 A * 11/1997 Gensheimer et al. .... 101/350.1
6,453,812 B1 * 9/2002 Ikeda et al. ..... 101/365
6,732,645 B1 * 5/2004 Yamamoto et al. ..... 101/365
6,915,737 B1 * 7/2005 Hirano et al. ..... 101/100

FOREIGN PATENT DOCUMENTS

JP 05-147200 6/1993

* cited by examiner

*Primary Examiner*—Andrew H. Hirshfeld
*Assistant Examiner*—Leo T. Hinze
(74) *Attorney, Agent, or Firm*—The Webb Law Firm

(57) ABSTRACT

A method of controlling an ink transfer roller is provided. This method achieves stabilized printing quality by evenly distributing ink transfer actions of the ink transfer roller for the number of rotation of a plate cylinder. The ink transfer action of an ink transfer roller is controlled based on the fact whether a value obtained by setting the value of C after calculation as a hysteresis value and adding the number ratio thereto exceeds a predetermined basic value or not, thereby allowing the ink transfer roller to perform ink transfer actions evenly at the number ratio set by an operator. With this method, unevenness in printing quality can be prevented.

7 Claims, 6 Drawing Sheets

FIG. 5

| NUMBER OF ROTATION (TIMES) | – | 1 | 2 | 3 | 4 | 5 | 6 | 7 | 8 | 9 | 10 | 1 | ··· |
|---|---|---|---|---|---|---|---|---|---|---|---|---|---|
| B/A | – | 0.7 | 0.7 | 0.7 | 0.7 | 0.7 | 0.7 | 0.7 | 0.7 | 0.7 | 0.7 | 0.7 | ··· |
| ⌈C⌋+(B/A) | – | 1.7 | 1.4 | 1.1 | 0.8 | 1.5 | 1.2 | 0.9 | 1.6 | 1.3 | 1.0 | 1.7 | ··· |
| X | – | 1.0 | 1.0 | 1.0 | 0 | 1.0 | 1.0 | 0 | 1.0 | 1.0 | 0 | 1.0 | ··· |
| C AFTER CALCULATION | 1.0 | 0.7 | 0.4 | 0.1 | 0.8 | 0.5 | 0.2 | 0.9 | 0.6 | 0.3 | 1.0 | 0.7 | ··· |

P1

| 2 | 1 | 2 | 3 | 4 | 5 | 1 | 2 | 3 | 4 | 5 | 1 | ··· |
|---|---|---|---|---|---|---|---|---|---|---|---|---|
| 0.7 | 0.4 | 0.4 | 0.4 | 0.4 | 0.4 | 0.4 | 0.4 | 0.4 | 0.4 | 0.4 | 0.4 | ··· |
| 1.4 | 0.8 | 1.2 | 0.6 | 1.0 | 1.4 | 0.8 | 1.2 | 0.6 | 1.0 | 1.4 | 0.8 | ··· |
| 1.0 | 0 | 1.0 | 0 | 0 | 1.0 | 0 | 1.0 | 0 | 0 | 1.0 | 0 | ··· |
| 0.4 | 0.8 | 0.2 | 0.6 | 1.0 | 0.4 | 0.8 | 0.2 | 0.6 | 1.0 | 0.4 | 0.8 | ··· |

P2

FIG. 6

| NUMBER RATIO | 1ST | 2ND | 3RD | 4TH | 5TH | 6TH | 7TH | 8TH | 9TH | 10TH |
|---|---|---|---|---|---|---|---|---|---|---|
| 1 / 10 | ○ | × | × | × | × | × | × | × | × | × |
| 2 / 10 | ○ | × | × | × | × | ○ | × | × | × | × |
| 3 / 10 | ○ | × | × | ○ | × | × | ○ | × | × | × |
| 4 / 10 | ○ | × | ○ | × | × | ○ | × | ○ | × | × |
| 5 / 10 | ○ | × | ○ | × | ○ | × | ○ | × | ○ | × |
| 6 / 10 | ○ | ○ | × | ○ | × | ○ | ○ | × | ○ | × |
| 7 / 10 | ○ | ○ | ○ | × | ○ | ○ | × | ○ | ○ | × |
| 8 / 10 | ○ | ○ | ○ | ○ | × | ○ | ○ | ○ | ○ | × |
| 9 / 10 | ○ | ○ | ○ | ○ | ○ | ○ | ○ | ○ | ○ | × |
| 10 / 10 | ○ | ○ | ○ | ○ | ○ | ○ | ○ | ○ | ○ | ○ |

PRINTING PRESS AND METHOD OF CONTROLLING INK TRANSFER ROLLER

CROSS REFERENCE TO RELATED APPLICATION

This application claims priority from Japanese Patent Application No. 2004-197585, which is incorporated herein by reference.

BACKGROUND OF THE INVENTION

1. Field of the Invention

The present invention relates to a printing press that uses an ink transfer roller disposed between an ink fountain and an ink roller to transfer ink stored in the ink fountain to the ink roller and a method of controlling the ink transfer roller.

2. Related Art

In conventional printing presses (e.g., sheet-fed printing presses), when ink stored in an ink fountain is supplied to a plate cylinder via an ink transfer roller, an ink fountain key provided in the ink fountain is opened to transfer the ink to the ink fountain roller (source roller) and the ink is transferred to the ink transfer roller disposed between the ink fountain roller and an ink roller, thereby transferring the ink from the ink transfer roller to the ink roller. In this arrangement, the ink transfer roller is reciprocated (moved back and forth) once every predetermined number of rotations of the plate cylinder. This arrangement may pose a problem that, for example, when an image having a small image area ratio (i.e., an image having a small image area to which ink is applied) is printed, etc., it is difficult to adjust particularly the amount of ink transfer and thus even if the ink fountain key is set at a minimum gap, an excessive amount of ink may be transferred. In light of this, there was proposed a technique to stop a reciprocating action of the ink transfer roller at a certain timing, as well as adjusting the opening degree of the ink fountain key, such as in Japanese Patent Application Laid-open No. Hei-05-147200.

In an ink supply unit of the above conventional printing press, when the adjustment of the amount of ink to be transferred cannot be achieved merely by adjusting the opening degree of the ink fountain key, the reciprocating action of the ink transfer roller is intermittently stopped. For example, with the arrangement where the ink transfer roller is to be reciprocated only once for two rotations of the plate cylinder, once the reciprocating action of the ink transfer roller has been completed, the ink transfer roller is kept stopped until the next action, which action is made after a predetermined number of rotations of the plate cylinder.

In the above conventional printing press, the ink transfer roller is designed to be simply reciprocated once for a predetermined number of rotations of the plate cylinder and the ink transfer roller is kept stopped thereafter until the plate cylinder has been rotated a predetermined number of times. With this arrangement having the ink transfer roller kept stopped, a rotation ratio between the ink transfer roller and the plate cylinder cannot be set in the middle range between 1/1 (1 to 1) and 1/2 (1 to 2). Accordingly, it is necessary to greatly change the opening degree of the ink fountain key. In addition, since it takes time to reflect the change of the opening degree of the ink fountain key to the density of ink on a print, the relevant operation is difficult to perform and the printing quality is hardly stabilized.

Therefore, it is an object of the present invention to provide a printing press and a method of controlling an ink transfer roller that are able to stabilize printing quality.

SUMMARY OF THE INVENTION

According to an aspect of the present invention, there is provided a printing press that includes an ink transfer roller that is reciprocatively moved between an ink fountain and an ink roller to transfer ink stored in the ink fountain to a plate cylinder through the ink roller and a control unit for controlling the ink transfer roller, in which the control unit has a function of setting a number ratio of the number of reciprocating actions of the ink transfer roller to the number of rotations of the plate cylinder to an irreducible fraction ratio, in which the number of reciprocating actions of the ink transfer roller is not 1.

With the above printing press, in which the control unit has a function of setting the number ratio of the number of reciprocating actions of the ink transfer roller to the number of rotations of the plate cylinder to an irreducible fraction ratio in which the number of reciprocating actions of the ink transfer roller is not 1, plural reciprocating actions of the ink transfer roller can be performed for the rotation of the plate cylinder so that the amount of ink transferred to the ink roller can be set finely as much. As a result, it is possible to more stabilize the printing quality, compared with the case where the ink is once transferred for the predetermined number of rotations of the plate cylinder.

Especially, the control unit may have a function of allowing the ink transfer roller to be reciprocatively moved at a timing determined by evenly distributing the number of reciprocating actions of the ink transfer roller for the number of rotations of the plate cylinder. Accordingly, since the plural actions of the ink transfer roller are evenly caused, it is possible to further stabilize the printing quality.

In addition, the control unit may have a function of activating the ink transfer roller in case of $C>1.0$ and deactivating the ink transfer roller in case of $C \leqq 1.0$, when a new basic value $C=C+B/A$ is calculated by adding $B/A$ to a basic value $C$ every rotation of the plate cylinder where $A$ denotes the number of rotations of the plate cylinder and $B$ denotes the number of reciprocating actions of the ink transfer roller. According to the function described above, when the number ratio is changed, the reciprocating actions of the ink transfer roller can be performed evenly in accordance with the changed number ratio and such reciprocating actions with the changed number ratio reflected thereto can be performed just from the next rotation of the plate cylinder. Accordingly, it is possible to effectively prevent unevenness in printing quality.

The control unit may have a function of preparing in advance a distribution table in which the reciprocating actions of the ink transfer roller are evenly distributed for the number of rotations of the plate cylinder and determining the number of reciprocating actions of the ink transfer roller to the number of rotations of the plate cylinder in accordance with the timing distribution of the distribution table. As a result, since the ink transfer roller can be activated in accordance with the timing distribution of the distribution table, it is possible to more precisely transfer ink to the ink roller than a case where ink is transferred once for the number of rotations of the plate cylinder and it is thus possible to stabilize the printing quality.

According to another aspect of the present invention, there is provided a method of controlling an ink transfer roller that is reciprocatively moved between an ink fountain and an ink roller to transfer ink stored in the ink fountain to a plate cylinder through the ink roller, includes setting the number ratio of the number of reciprocating actions of the ink transfer roller to the number of rotations of the plate cylinder to an irreducible fraction ratio in which the number of reciprocating actions of the ink transfer roller is not 1, based on which irreducible fraction ratio the ink transfer roller is reciprocatively moved.

Since plural reciprocating actions of the ink transfer roller can be performed for the number of rotations of the plate cylinder by activating the ink transfer roller as described above and the amount of ink transferred to the ink roller can be set finely as much, it is possible to more stabilize the printing quality, compared with the case where the ink is once transferred for the predetermined number of rotations of the plate cylinder. Specifically, the ink transfer roller is reciprocatively moved at a timing determined by evenly distributing the number of reciprocating actions of the ink transfer roller for the number of rotations of the plate cylinder. This results in more stabilized printing quality.

In addition, the ink transfer roller may be activated in case of $C>1.0$ and is deactivated in case of $C \leqq 1.0$, when a new basic value $C=C+B/A$ is calculated by adding $B/A$ to a basic value C every rotation of the plate cylinder where A denotes the number of rotations of the plate cylinder and B denotes the number of reciprocating actions of the ink transfer roller. According to this, when the number ratio is changed, the reciprocating actions of the ink transfer roller can be performed evenly in accordance with the changed number ratio and such reciprocating actions with the changed number ratio reflected thereto can be performed just from the next rotation of the plate cylinder. Accordingly, it is possible to effectively prevent unevenness in printing quality.

In a control method according to the present invention, the transfer of ink to the ink roller can be evenly performed plural times for the number of rotations of the plate cylinder. Accordingly, uneven printing, which may affect the printing quality, can be effectively prevented, and thereby the printing quality can be improved.

BRIEF DESCRIPTION OF THE DRAWINGS

The above, and other objects, features and advantages of the present invention will become apparent from the detailed description thereof in conjunction with the accompanying drawings wherein.

FIG. 5 is a chart illustrating an reciprocating action of an ink transfer roller which is controlled according to the flowchart illustrated in FIG. 4.

FIG. 6 is a chart illustrating on and off states for driving the ink transfer roller in a control method according to another embodiment of the present invention.

DETAILED DESCRIPTION OF THE PREFERRED EMBODIMENT

Figure 1:
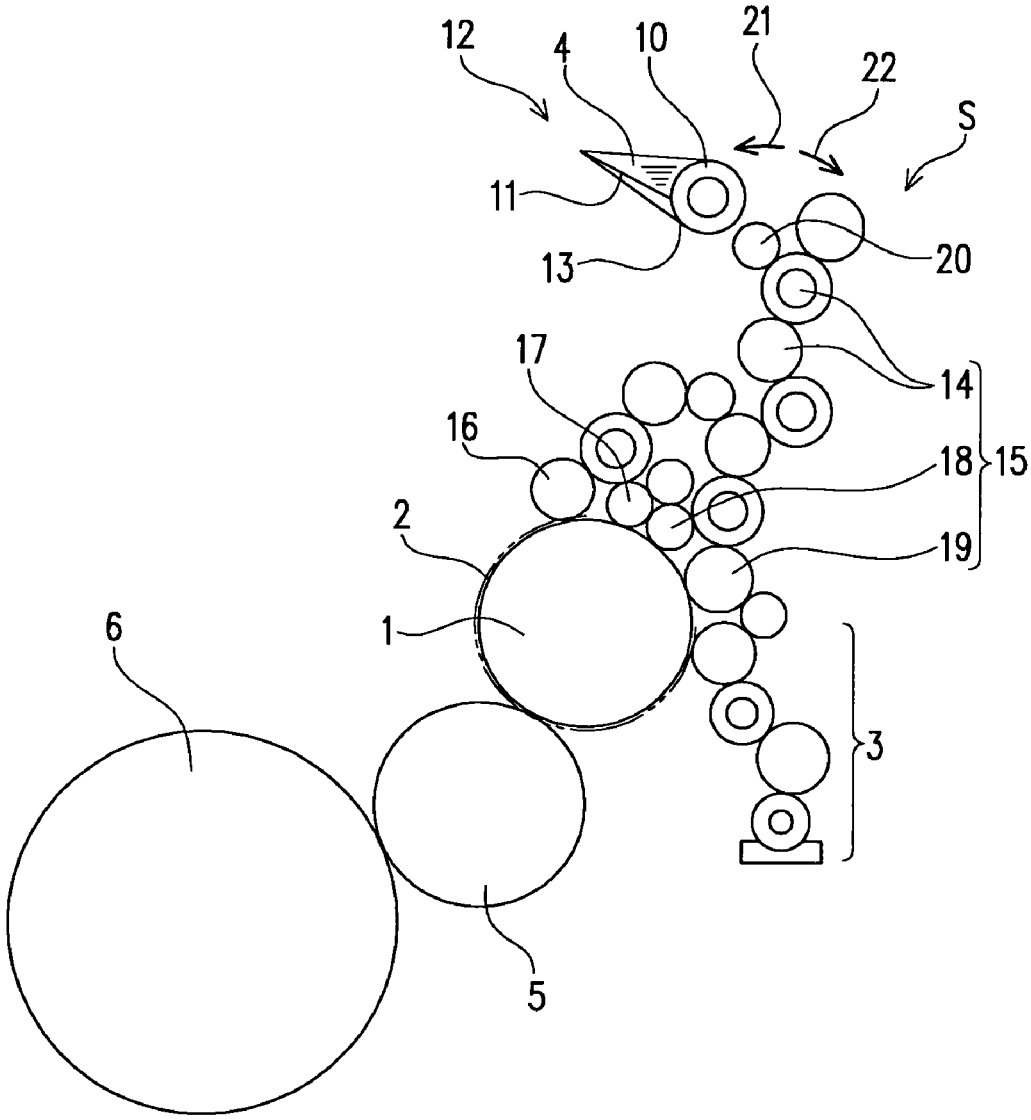
FIG. 1 is a schematic side view illustrating an ink supply unit of a printing press according to an embodiment of the present invention.
Figure 2:
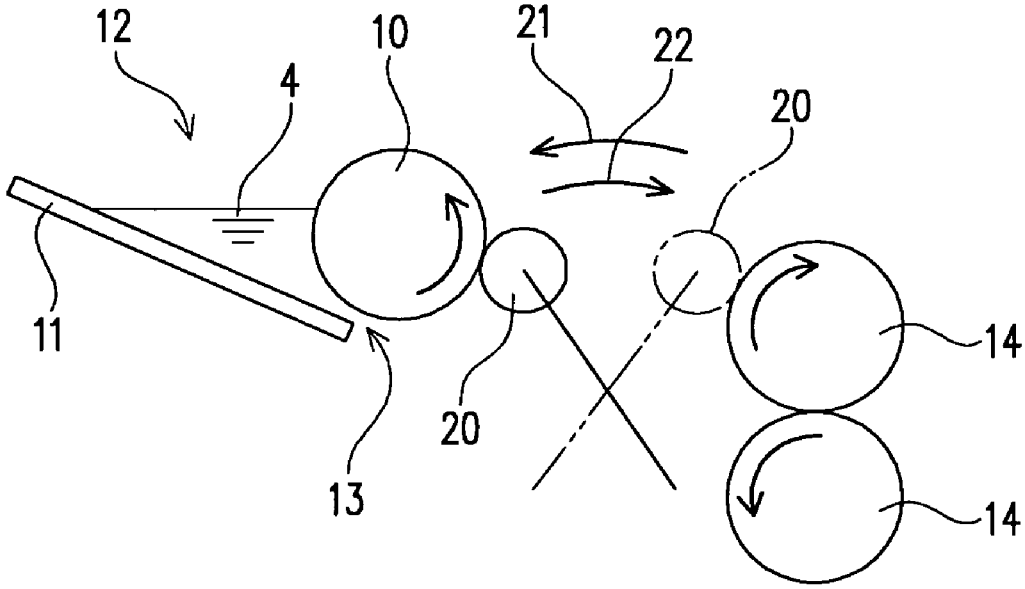
FIG. 2 is an enlarged side view schematically illustrating a part of the ink supply unit.

Now, the description will be made for an example of a method of controlling an ink transfer roller of a printing press (e.g., an offset sheet-fed printing press) according to an embodiment of the present invention, with reference to the drawings attached hereto. FIG. 1 is a schematic side view illustrating an ink supply unit of a printing press according to an embodiment of the present invention. FIG. 2 is an enlarged side view schematically illustrating a part of the ink supply unit. Referring to the Figures, the printing press includes an ink supply unit S for supplying ink to a printing plate 2 mounted on a plate cylinder 1 and a water supply unit 3 for supplying water to the printing plate 2. Ink 4 and dampening water are supplied to the printing plate 2 mounted on the outer circumference of the plate cylinder 1. Thus, printing is made on each sheet of paper passing between an impression cylinder 6 and a rubber cylinder (blanket cylinder) 5 with the ink 4 transferred through the rubber cylinder 5 from the plate cylinder 1.

The ink supply unit S includes an ink fountain 12 made up of an ink fountain roller 10 and a blade 11. The ink 4 stored in the ink fountain 12 flows out through a gap 13 between the ink fountain roller 10 and the blade 11 and is supplied to the outer circumference of the rotating ink fountain roller 10. The blade 11 includes a plurality of ink fountain keys which are aligned in a direction parallel to the axis of the ink fountain roller 10, in which the opening degree of each ink fountain key can be adjusted. The gap 13 can be adjusted by opening and closing the blade 11. That is, as the opening degree of the blade 11 is increased, the gap 13 becomes greater and thus the amount of ink flowing out of the ink fountain 12 is increased, and as the opening degree of the blade 11 is decreased, the gap 13 becomes smaller and thus the amount of ink flowing out of the ink fountain 12 is decreased. The ink flowing out of the ink fountain 12 to the ink fountain roller 10 is supplied to the printing plate 2 through an ink roller group 15 made up of a plurality of ink rollers 14. The ink rollers 14 are disposed in parallel with the ink fountain roller 10, the plate cylinder 1 and the like and thus transfer the ink sequentially from the upstream to the downstream. Ink form rollers 16, 17, 18, and 19 located most downstream are designed to be capable of contacting the plate cylinder 1.

An ink transfer roller (also referred to as a ductor roller) 20, which can be reciprocated (moved back and forth) between the ink roller 14 located most upstream and the ink fountain roller 10 by means of a pivotal action, is disposed between both the rollers. The ink transfer roller 20 performs an ink transfer action, i.e., an reciprocating action between both the rollers in the directions indicated by the arrows 21 and 22 at a predetermined interval and transfers the ink attached to the outer circumference of the ink fountain roller 10 to the ink roller 14 by means of the ink transfer action. In this way, the ink 4 stored in the ink fountain 12 is transferred to the ink roller 14 through the ink fountain roller 10 and the ink transfer roller 20 and is supplied to the printing plate 2 by bringing the ink form rollers 16 to 19 into contact with the printing plate 2. It is necessary to attach to the ink roller 14 a basic ink layer at least minimum for each printing operation.

Figure 3:
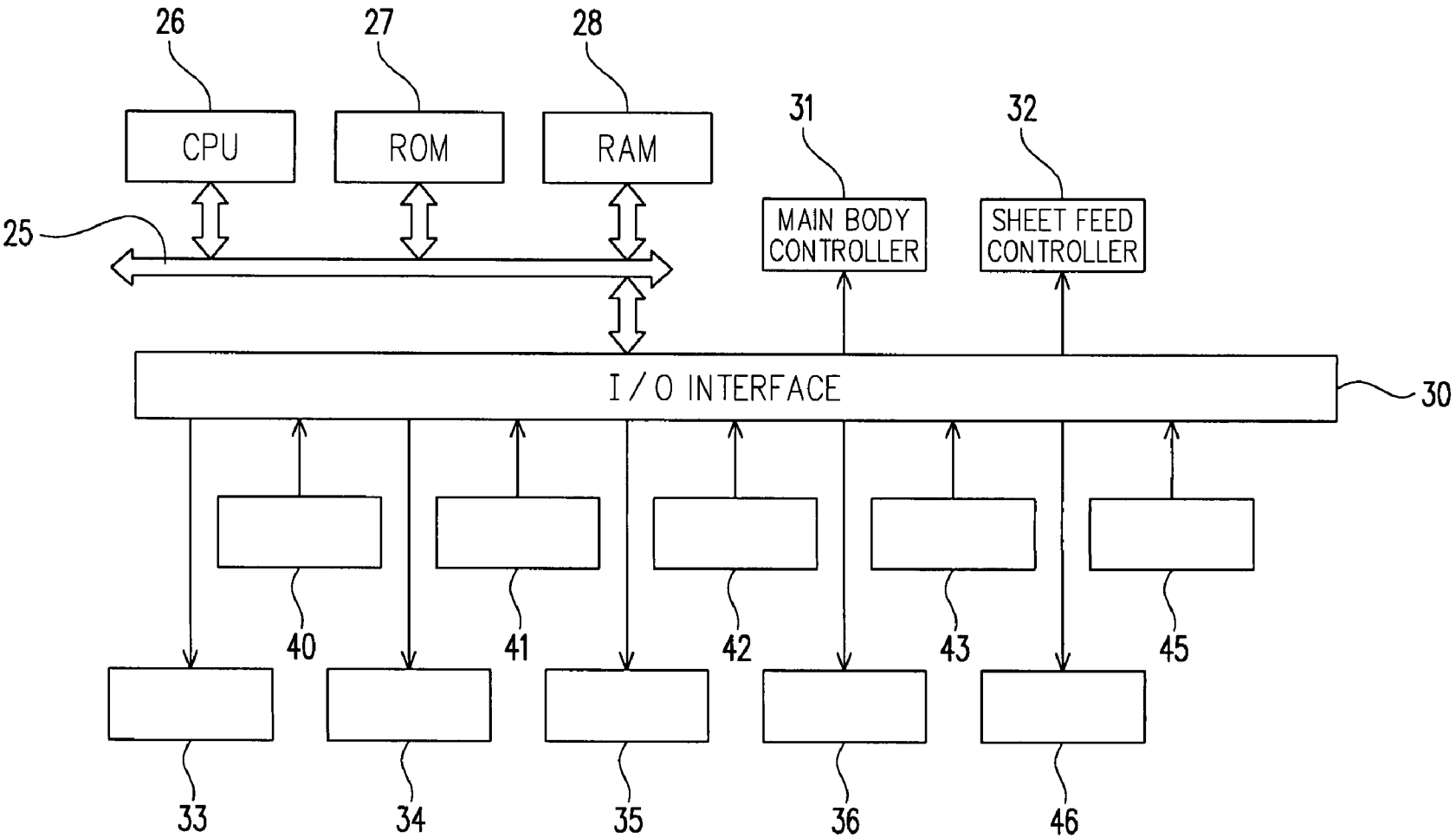
FIG. 3 is a block diagram illustrating a hardware of the ink supply unit.

FIG. 3 is a block diagram illustrating a part of a hardware of the ink supply unit S. A CPU 26 as a controller, a ROM 27 and a RAM 28 are connected to a balance line 25. The CPU 26 has a function of controlling all the driving units of the printing press in accordance with a program stored in the ROM 27. A main body controller 31 and a sheet feed controller 32 are connected to the balance line 25 via an I/O interface 30. The main body controller 31 controls the rotations of all the cylinders and the rollers of the printing press. The sheet feed controller 32 controls a feeder unit for proper sheet feeding. An ink fountain key controller 33, an ink fountain roller controller 34, an ink transfer roller controller 35 and an ink form roller controller 36 are connected to the balance line 25 via the I/O interface 30. The ink form roller controller 36 has a function of controlling contact or non-contact of the ink form rollers 16 to 19 of the ink roller group 15 relative to the plate cylinder 1. The ink fountain key controller 33 controls the ink fountain keys of the ink fountain 12 to control their opening degrees. The ink fountain roller controller 34 has a function of controlling the number of rotations of the ink fountain roller 10. The ink transfer roller controller 35 has a function of controlling the ink transfer action of the ink transfer roller 20.

A sheet-type selection input unit 40, a pattern input unit 41, a main-body start input unit 42, an inking start input unit 43, a reciprocating number input unit 45 and a display unit 46 are connected to the balance line 25 via the I/O interface 30. An operator selects and inputs the type of sheet through the sheet-type selection input unit 40 and selects and inputs inking details on whether to start inking or preset inking, through the pattern input unit 1. The CPU 26 recognizes the input and performs the control corresponding to the input. When the operator has input these information through the main-body start input unit 42, the CPU 26 recognizes the input information and controls the main body controller 31. When the operator has input those information through the inking start input unit 43, the CPU 26 recognizes the input information and controls the ink fountain key controller 33, the ink fountain roller controller 34, the ink transfer roller controller 35, etc., so as to perform an inking operation. The CPU 26 displays the number of reciprocating actions of the ink transfer roller 20 on the display unit 46, allowing the operator to confirm the same and input a desired number of reciprocating actions through the reciprocating number input unit 45. The CPU 26 recognizes the input and controls the ink transfer roller controller 35 in accordance with the input number of reciprocating actions.

In the printing press according to this embodiment, by intermittently stopping a driving unit for the ink transfer roller (ink transfer roller driving unit) connected to the ink transfer roller controller 35 in accordance with the number of rotations of the plate cylinder 1, the pivotal action, i.e., an ink transfer action of the ink transfer roller 20 is intermittently stopped at predetermined interval, that is, in accordance with the ratio of the number of reciprocating actions of the ink transfer roller 20 to the number of rotations of the plate cylinder 1, thereby adjusting and changing the amount of ink transferred to the ink roller 14. The timing for intermittently driving and stopping the ink transfer roller driving unit is determined on the basis of the following control. That is, it is supposed that;

A: denominator (the number of rotations of the plate cylinder)

B: numerator (the number of reciprocating actions of the ink transfer roller)

C: basic value (threshold value which is recalculated every rotation of the plate cylinder), 1.0 is used as the initial value of C to calculate C=C+B/A. When C>1.0 (the basic value C is greater than 1.0), the ink transfer roller driving unit is activated. That is, the ink transfer roller 20 is reciprocatively moved. When the basic value C is equal to or less than 1.0, the ink transfer roller driving unit is stopped. That is, the reciprocating action of the ink transfer roller 20 is stopped.

Figure 4:
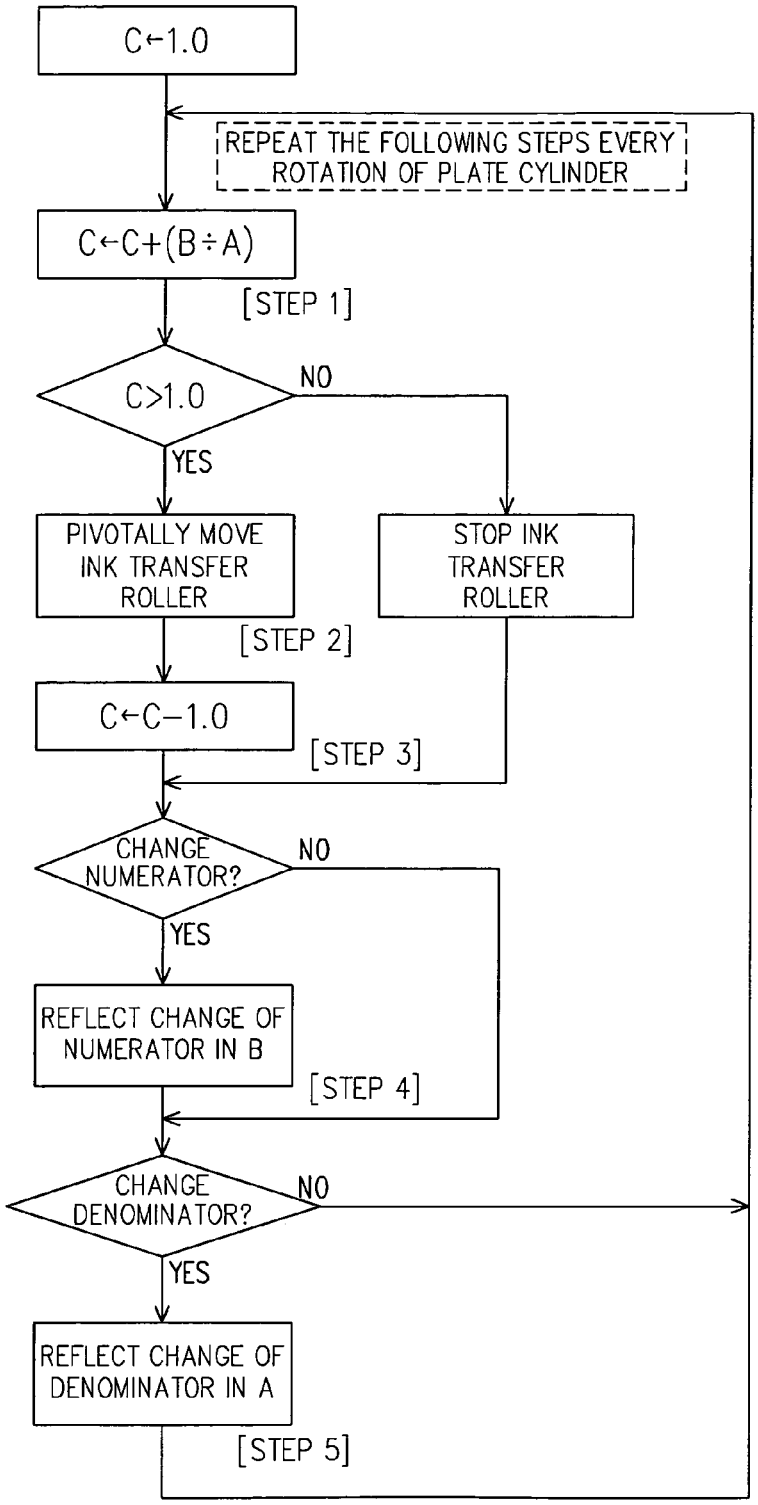
FIG. 4 is a flowchart of a program stored in a ROM of FIG. 3.

Now, the description will be made with reference to the flowchart illustrated in FIG. 4 for a distinguished feature of the control method, using a program stored in the ROM 27, which allows the amount of ink transferred to the ink roller 4 to be changed. When starting the operation, the ROM 27 sets the initial basic value of C to 1.0. When the operator has set the B/A ratio by operating the reciprocating number input unit 45, the ROM 27 performs the calculation of adding B/A to the basic value (Step 1). Accordingly, since the value of C obtained through the calculation is greater than the initial basic value 1.0 (C>1.0), the ROM 27 outputs a driving signal to the ink transfer roller driving unit (Step 2). When C>1.0, the ROM 27 performs the calculation of subtracting the initial basic value C=1.0 from the value of C to which B/C has been added (Step 3). When B (numerator) has been changed, the changed value is reflected in the subsequent value of B (Step 4) and when A (denominator) has been changed, the changed value is reflected in the subsequent value of A (Step 5). The ROM 27 repeats the above-mentioned steps every rotation of the plate cylinder 1.

FIG. 5 illustrates a specific example of controlling manners of the ink transfer roller driving unit. This example relates to controlling of the ink transfer roller driving unit when the operator has set A=10 (the number of rotations of the plate cylinder) and B=7 (the number of reciprocating actions) by operating the reciprocating input unit 45 to start a printing operation. In FIG. 5, "1.0" of the section "X" denotes activation of the ink transfer roller driving unit and "0" of the section "X" denotes deactivation of the ink transfer roller driving unit. When the operator is to operate the reciprocating number input unit 45 and set the values of A and B, a display portion in which integers are set as the values of A and B is operated.

For example, at the first rotation of the plate cylinder 1, B/A=0.7 means 7/10 and "C"+(B÷A)=1.7 means 17/10. The value of "C" in "C"+(B÷A) is the value of C at the previous rotation and is a hysteresis value of C. The value of C that is a threshold value to be recalculated every rotation of the plate cylinder is calculated by means of "C"+(B÷A)−X. In the Figure, when the number of reciprocating actions of the ink transfer roller 20 is set to 7 times relative to 10 rotations of the plate cylinder 1, the ink transfer roller driving unit is activated at the first to third, fifth, sixth, eighth, and ninth rotations of the plate cylinder 1 and is deactivated at the fourth, seventh, and tenth rotations of the plate cylinder 1. It is apparent from this that the seven times of the ink transfer actions (reciprocating actions) of the ink transfer roller 20 are intermittently and evenly distributed in the span of ten rotations of the plate cylinder 1 (in the span indicated by the arrow P1 in FIG. 5). In other words, the deactivated states of the ink transfer roller driving unit take place intermittently and evenly. In addition, the above-mentioned control is repeated when the operator does not operate the reciprocating number input unit 45.

As an example, a discussion will be made for a case where the operator operates the reciprocating number input unit 45 to reset the number ratio from the current number ratio of 7/10 to 2/5 during rotation of the plate cylinder 1, for example, at the time of finishing the second rotation, so as to reset the number ratio to a small ratio. This case is illustrated in the lower portion of FIG. 5. Here, since the number ratio is reduced to 2/5 from 7/10, it is preferable that the ink transfer roller 20 is stopped (i.e., the reciprocating action is not performed) at the third rotation of the plate cylinder 1. Therefore, referring to the lower portion of FIG. 5, the value of "C"+(B÷A) at the third rotation is 0.8, which is not larger than the basic value 1.0. That is, the ink transfer roller driving unit is kept stopped, allowing no ink to be supplied to the plate cylinder 1, as desired by the operator. In addition, when the number ratio is set to 2/5, the ink transfer roller driving unit is activated at the second and fifth rotations and is deactivated at the first, third, and fourth rotations. In this way, two times of the reciprocating actions of the ink transfer roller 20 are intermittently and evenly distributed in 5 rotations of the plate cylinder 1 (in the span indicated by the arrow P2 in FIG. 5). The above-mentioned actions are repeated as long as the value of B/A is not changed.

In the control method, when the basic value C after calculation is set as a hysteresis value and a value obtained by adding the number ratio thereto exceeds a predetermined basic value, the ink transfer action performed and a basic value for calculation from which the predetermined basic value 1.0 is subtracted is set as a new hysteresis value. On the other hand, when the basic value C after calculation is set as a hysteresis value and a value obtained by adding the number ratio thereto does not exceed a predetermined basic value, the ink transfer action is not performed and the value to which the number ratio is added is still employed as a hysteresis value of the basic value C. That is, this control method can be said as an one using an error diffusion technique. According to this control method, when the denominator and numerator, that is, the number ratio, associated with the ink transfer action of the ink transfer roller 20 is arbitrarily set, the activation and deactivation of the driving unit for the ink transfer roller 20 can be determined in accordance with the corresponding setting. At the time of arbitrarily setting the number ratio, for example, there can be two options, one being that a part for displaying the number ratios which can be set in advance is provided on an operation unit (operation panel) of the printing press so that the operator operates the display part, and another being that the operator inputs currently proper denominators and numerators as needed.

In the control method, the number of the reciprocating actions of the ink transfer roller 20 relative to the number of rotation (denominator) can be set and changed even while the plate cylinder 1 rotates. In addition, the ink transfer roller driving unit is controlled based on the fact whether a value obtained by setting the value of C after calculation as a hysteresis value and adding the number ratio thereto exceeds a predetermined basic value or not. As a result, the amount of ink transferred to the ink roller 14 can be adjusted so that the activated states of the ink transfer roller driving unit corresponding to the number ratio set by the operator are evenly generated. In addition, since ink is transferred to the ink roller 14 at an average timing during rotation of the plate cylinder, it is possible to effectively prevent unevenness in printing quality. Since the amount of ink transferred to the ink roller 14 can be finely adjusted at the side of the ink transfer roller 20 by evenly distributing the ink transfer action of the ink transfer roller 20, it is not necessary for the operator to adjust the opening degree of the ink fountain 12 (blade 11) without the necessity to take a complicated operation. In the control method, since the value of C after calculation is used as a hysteresis value, the activation or deactivation of the ink transfer roller driving unit can be performed just from the next rotation of the plate cylinder 1 evenly in accordance with the changed number ratio even when the number ratio has been changed during a printing operation. Therefore, it is possible to effectively prevent unevenness in printing quality.

FIG. 6 illustrates another embodiment. This embodiment relates to a control method of storing a distribution of timing for activating or deactivating the ink transfer roller driving unit in the form of a distribution table in the RAM 28 and controlling the action of the ink transfer roller 20 in accordance with the contents of the distribution table. In the control method, for example, when the denominator of the number ratio is set to 10 and the numerator thereof is changed in the range of 1 to 10, it is preferable that the periods of the activation and deactivation of the ink transfer roller driving unit are evenly distributed as described below. In FIG. 6, the pivotal action (ink transfer action) of the ink transfer roller 20 by the activation of the ink transfer roller driving unit is denoted by "O" and the stopping of the ink transfer roller 20 by the deactivation of the ink transfer roller driving unit is denoted by "x". For example, when the number ratio is 7/10, seven times of the pivotal actions are evenly performed relative to 10 rotations of the plate cylinder 1. For example, when the number ratio is changed from 7/10 to 2/5, the ink transfer actions of the ink transfer roller 20 corresponding to the number ratio of 2/5 can be performed, thereby effectively preventing unevenness in printing quality.

For the control method as described above, which controls the ink transfer of the ink transfer roller 20 by preparing a distribution table, a technique of reducing the number ratio can be considered. For example, a distribution table in which, for example, the number ratio of 5/10 is reduced to 1/2 and the number ratio of 6/10 is reduced to 3/5 is prepared and the pivotal action and stopping of the ink transfer roller 20 can be controlled in accordance with the distribution table. In the technique, since the period is shorter than that of the case where the denominator is 10, it is easy to prepare the distribution table.

This specification is by no means intended to restrict the present invention to the preferred embodiments set forth therein. Various modifications to the printing press and the method of controlling ink transfer roller, as described herein, may be made by those skilled in the art without departing from the spirit and scope of the present invention as defined in the appended claims.

What is claimed is:

1. A printing press comprising:

an ink transfer roller that is reciprocatively moved between an ink fountain and an ink roller to transfer ink stored in the ink fountain to a plate cylinder through the ink roller; and a control unit for controlling the ink transfer roller, said control unit having a function of setting a number ratio of the number of reciprocating actions of the ink transfer roller to the number of rotations of the plate cylinder to an irreducible fraction ratio, in which the number of reciprocating actions of the ink transfer roller is not 1.

2. The printing press according to claim 1, wherein the control unit has a function of allowing the ink transfer roller to be reciprocatively moved at a timing determined by evenly distributing the number of reciprocating actions of the ink transfer roller for the number of rotations of the plate cylinder.

3. The printing press according to claim 2, wherein the control unit has a function of activating the ink transfer roller in case of $C>1.0$ and deactivating the ink transfer roller in case of $C \leqq 1.0$, when a new basic value $C=C+B/A$ is calculated by adding B/A to a basic value C every rotation of the plate cylinder where A denotes the number of rotations of the plate cylinder and B denotes the number of reciprocating actions of the ink transfer roller.

4. The printing press according to claim 1, wherein the control unit has a function of preparing in advance a distribution table in which the reciprocating actions of the ink transfer roller are evenly distributed for the number of rotations of the plate cylinder and determining the number of reciprocating actions of the ink transfer roller to the number of rotations of the plate cylinder in accordance with the distribution of the distribution table.

5. A method of controlling an ink transfer roller that is reciprocatively moved between an ink fountain and an ink roller to transfer ink stored in the ink fountain to a plate cylinder through the ink roller, comprising:

setting the number ratio of the number of reciprocating actions of the ink transfer roller to the number of rotations of the plate cylinder to an irreducible fraction ratio in which the number of reciprocating actions of the ink transfer roller is not 1, based on which irreducible fraction ratio the ink transfer roller is reciprocatively moved.

6. The method of controlling an ink transfer roller according to claim 5, wherein the ink transfer roller is reciprocatively moved at a timing determined by evenly distributing the number of reciprocating actions of the ink transfer roller for the number of rotations of the plate cylinder.

7. The method of controlling an ink transfer roller according to claim 6, wherein the ink transfer roller is activated in case of $C>1.0$ and is deactivated in case of $C \leqq 1.0$, when a new basic value $C=C+B/A$ is calculated by adding $B/A$ to a basic value $C$ every rotation of the plate cylinder where $A$ denotes the number of rotations of the plate cylinder and $B$ denotes the number of reciprocating actions of the ink transfer roller.

* * * * *